US005803969A

United States Patent [19]

Knop

[11] Patent Number: 5,803,969

[45] Date of Patent: Sep. 8, 1998

[54] DEVICE FOR TWO-SIDED COATING OF A WEB OF MATERIAL

[75] Inventor: Reinhard Knop, Essen, Germany

[73] Assignee: Jagenberg Papiertechnik GmbH, Neuss, Germany

[21] Appl. No.: 809,002

[22] PCT Filed: Jul. 5, 1995

[86] PCT No.: PCT/EP95/02602

§ 371 Date: Feb. 28, 1997

§ 102(e) Date: Feb. 28, 1997

[87] PCT Pub. No.: WO96/07791

PCT Pub. Date: Mar. 14, 1996

[30] Foreign Application Priority Data

Sep. 2, 1994 [DE] Germany ..... 44 31 202.4

[51] Int. Cl.[6] ..... B05C 1/00

[52] U.S. Cl. ..... 118/227; 118/249; 118/255; 118/256; 118/261

[58] Field of Search ..... 118/123, 126, 118/216, 227, 249, 255, 256, 261; 427/428, 209, 211; 101/216, 219, 220

[56] References Cited

U.S. PATENT DOCUMENTS

| | | | |
|---|---|---|---|
| 5,431,731 | 7/1995 | Salo et al. | 118/255 |
| 5,503,674 | 4/1996 | Hofmann et al. | 118/123 |

FOREIGN PATENT DOCUMENTS

| | | |
|---|---|---|
| 06 08 201 A1 | 7/1994 | European Pat. Off. . |
| GM 71 01 055 | 1/1971 | Germany . |
| 34 40 634 C2 | 5/1986 | Germany . |
| 35 40 402 A1 | 5/1987 | Germany . |
| 37 01 670 A1 | 8/1988 | Germany . |
| 91 00 291 U1 | 5/1991 | Germany . |
| 42 18 596 A1 | 12/1993 | Germany . |

*Primary Examiner*—Laura Edwards
*Attorney, Agent, or Firm*—Herbert Dubno; Yuri Kateshov

[57] ABSTRACT

A device for two-sided coating of a web includes a pair of pressure rollers forming a nip therebetween, one of the rollers is shiftable along a direction of the common tangent of both rollers for the adjustment of the nip.

4 Claims, 2 Drawing Sheets

DEVICE FOR TWO-SIDED COATING OF A WEB OF MATERIAL

CROSS REFERENCE TO RELATED APPLICATIONS

This is a national phase application of PCT/EP95/02602 filed 5 Jul. 1995, published as WO96/07791 Mar. 14, 1996, and based, in turn, upon German application P4431202.4 filed 25 Sep. 1994 under the International Convention.

FIELD OF THE INVENTION

The invention relates to a device for two-sided coating of a web of material, particularly a paper or cardboard web.

BACKGROUND OF THE INVENTION

There are known devices for the two-sided application of glue, starch, carboxymethylcellulose, synthetic glue or pigment dispersions onto paper or cardboard webs, which have two axially parallel pressure rollers next to each other rotatably supported in a frame, and between which a nip is formed through which the paper or cardboard web is guided. At each of the pressure rollers an application and metering system is provided, which first applies a metered film of coating material to their peripheral surface, this film being then transferred to the web in the nip. It is known to support one of the two pressure rollers so that it is circumferentially movable with respect to the other, in order to open the nip for the introduction of a new web.

In the device of DE-C 34 40 634 one of the pressure rollers is swingably supported with respect to the other. The web is guided out of the nip by web guiding elements, e.g. guide rollers, to the following processing stations, which can include e.g. a drier.

It has proven to be very important for achieving an optimal coating quality that the coated paper or cardboard webs are withdrawn from the surfaces of the two pressure rollers along a stable, unchanged web, path. The web held on the rollers by cohesion and adhesion forces, has to be withdrawn as uniformly as possible first from the one roller and then from the second roller, without uncontrolled web motions, i.e. a web waving, occurring between the two pressure rollers. An uncontrolled web path leads to undesirable surface markings.

In order to withdraw the web at first from the first pressure roller and then from the second pressure roller, it is known to influence the adhesion forces acting during web withdrawal in a controlled manner, by means of different materials on the surfaces of the pressure rollers. However, this solution has the drawback that the different roller surfaces can also lead to differences in the quality of the coating.

One can continue to guide the web on one of the pressure rollers for a certain wrapping angle, after it leaves the nip (DE-C 34 40 634). Based on experience a certain web traction force has to be set at a wrapping angle which is not too big.

Since the behavior of the web during withdrawal from the pressure rollers does not depend only on the above-described features of the coating process, but also on the process parameters, such as the amount of coating and the physical parameters of the web and the coating material, the above-described negative effects can occur in the known devices, when, due to a change in the raw materials (web material and/or coating material), the conditions during web withdrawal become unstable. So for instance the web path can become unstable when, after being reset for a new variety, a coating material with considerable higher cohesion and adhesion forces is applied with the unwrapped pressure roller, which causes the web to be locally or totally entrained by the unwrapped pressure roller.

OBJECTS OF THE INVENTION

It is therefore the principal object of the present invention to provide a device overcoming drawbacks of the prior art.

SUMMARY OF THE INVENTION

According to the invention, a device for two-sided coating of a web of material, particularly paper or cardboard web, has two axially parallel pressure rollers rotatably supported next to each other in a frame. One of the rollers is supported circumferentially movable against the other pressure roller in order to form a nip, through which the web of material is guided, and a application and metering system for each pressure roller. One if the two pressure rollers is adjustably supported for the adjustment of the nip with a component in the direction of the common tangent of both pressure rollers in the nip.

The invention offers the possiibility of a stable web withdrawal form the pressure rollers, with changing web and/or coating materials, by setting the belt wrap retios at the pressure rollers.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
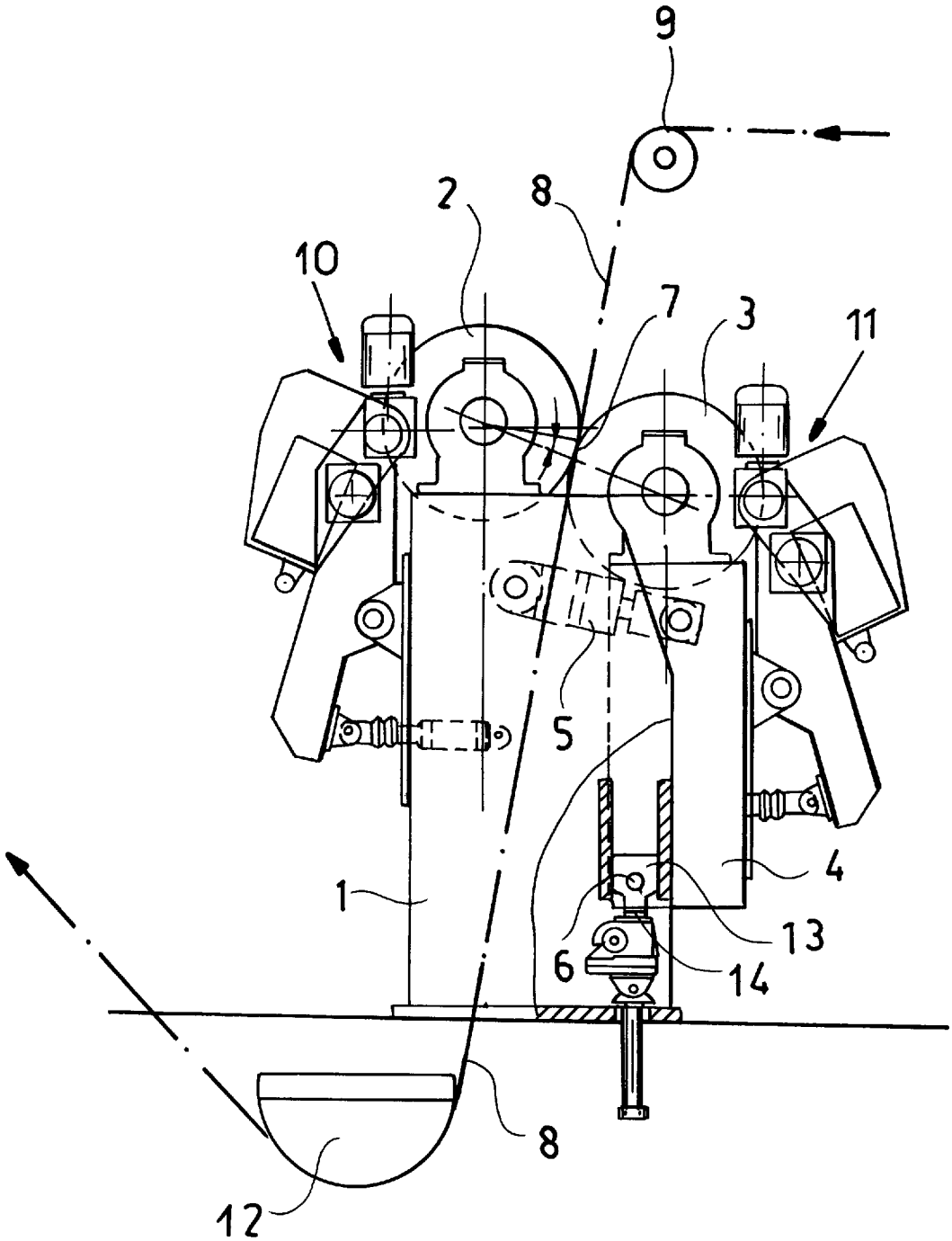
FIG. 1 is a side view of a coating device, wherein the pressure rollers are set so that the web is slightly wrapped around one pressure roller on the outgoing side.

The coating device shown in the drawing is integrated into a paper-making machine. It consists of two axially parallel pressure rollers 2, 3 arranged next to each other, rotatably supported in a frame 1, one of the pressure roller 2 is fixed, while the roller 3 is supported circumferentially movable with respect to the first pressure roller 2. The pressure roller 3 is suspended between two lateral swivel levers 4, which are swingably supported in the frame 1 and by means of a piston-cylinder unit 5 can be swung about a swivel axis 6 in the direction of the pressure roller 2 and away from it. The peripheral surfaces of pressure rollers 2, 3 are rubber-coated. When the pressure roller 3 is swung towards pressure roller 2, a nip 7 is formed, whereinto the paper web 8 to be coated is guided from above by a guide roller 9.

Outside the region of nip 7, on each pressure roller 2, 3 an application and metering system 10, 11 is arranged, which can be swung towards the respective pressure roller 2, 3. Preferably each application and metering system 10, 11 has an applicator chamber open to the respective pressure roller 2, 3, into which coating material is fed under pressure. On the outlet side, each applicator chamber is closed off by a metering element, which wipes the coating material down to the desired film thickness. A wiping rod with a structured surface, i.e. a surface having projections and depressions, is used as a dosage element, by means of which a volumetric metering is possible. Such wiping rods are known. They have for instance peripheral grooves, which can be produced by wrapping a wire around them or by surface processing. Alternately it is possible to use also wiping rods with smooth surfaces, scraping blades or scraping bars.

The coating material applied in a metered manner to the peripheral surfaces of pressure rollers 2, 3 is transferred to the web 8 in the nip 7. After running through the nip 7, the web 8 coated on both sides is guided to a drier (not shown in the drawing) by means of a contactless guide element 12.

In order to be able to set different belt wrap ratios of the web 8 at the pressure rollers 2, 3 without changing the rest of the web path, one of the two pressure rollers, preferably the swingably supported pressure roller 3, as shown in the illustrated embodiment, is supported adjustably by a component to move within the nip 7 towards the common tangent to the two pressure rollers 2, 3.

In the illustrated embodiment, this adjustability is achieved due to the fact that the swingable pressure roller 3 is also height-adjustably supported. For this purpose a bottom-supported piston-cylinder unit 14 engages at the linearly guided swivel bearing 13, by means of which the swivel lever 4 can be moved up or down. In this way the pressure roller 3 can swing towards the fixed pressure roller 2 following an adjustable path. A lifting of the swivel lever 4 causes an upward slide in the position of the nip 7. The changed nip leads to a wrapping of the pressure roller 2 on the outgoing side of web 8 (FIG. 2). Analogously, the lowering of the swivel lever 4 leads to a downward sliding of the nip 7, and therefore to the partial wrapping of the web 8 around the pressure roller 3 on the outgoing side (FIG. 1).

The maximal stroke of the piston-cylinder unit 14 and the length of the swivel lever 4 are selected so that, when the piston rod is only halfway extended, the web runs though the nip 7 in a straight line, without wrapping around a pressure roller 2, 3. The stroke length of the piston-cylinder unit 14 is so dimensioned that during the retraction of the piston, the pressure roller 3 is lowered until the connection line between the two rotation axes of the pressure rollers 2, 3 deviates from the rotation axis of pressure roller 2 by about 5–10 degrees (FIG. 1). In this position the swingably supported pressure roller 3 is slightly wrapped by the web 8 at the incoming side of the nip 7. When the piston of the piston-cylinder unit 14 is fully extended, the pressure roller 3 is lifted until the connection line between the two rotation axes of the pressure rollers 2, 3 is swung upwards by 5–10 degrees with respect to the position when the web 8 passes through in a straight line (FIG. 2). In this position the fixed pressure roller 2 is slightly wrapped by the web 8 on the outgoing side of the nip 7.

Figure 2:
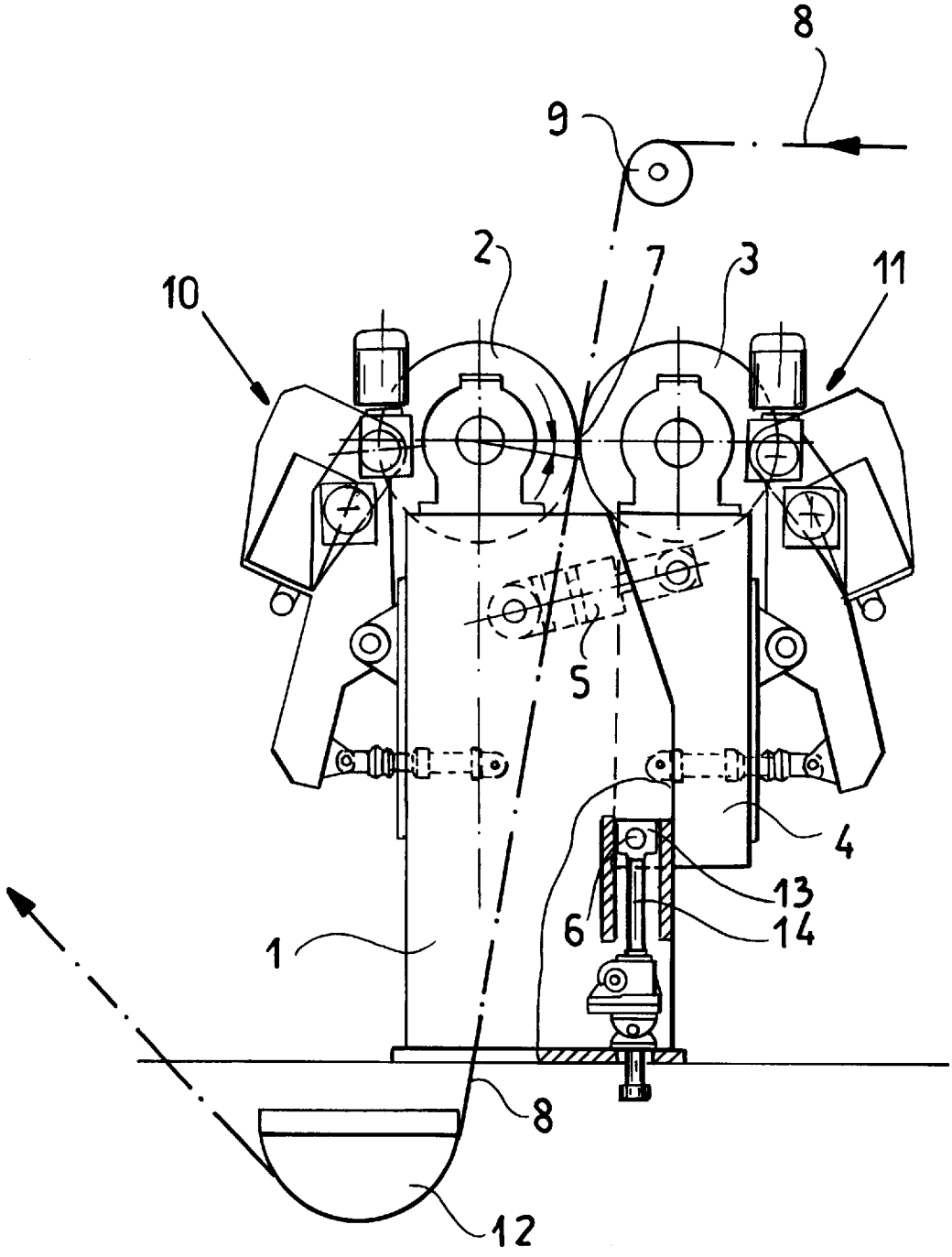
FIG. 2 is the sideview of the coating device wherein the other pressure roller is slightly wrapped at the incoming side.

In the position shown in FIG. 1 the web is first withdrawn from the pressure roller 2 and then from pressure roller 3. If after a resetting for a new variety, the pressure roller 2 applies a coating material with a higher cohesion and adhesion than the coating material applied by pressure roller 3, this would lead to an unstable web path. The cohesion and adhesion forces hold the web 8 longer at the pressure roller 2, the web guidance with the slight wrapping about the pressure roller 3 holds the web longer at the pressure roller 3. Therefore the holding forces are opposite. In order to restabilize the web path under these conditions, the pressure roller 3 is raised to the position shown in FIG. 2. Thereby the web path is modified so that now the pressure roller 2 is slightly wrapped on the outgoing side of the nip 7. In this way the forces resulting from the web guidance act now just like the cohesion and adhesion forces in the sense that the web is to be kept longer on the pressure roller 2. The web path is stable, since the web 8 is unequivocally withdrawn first from the pressure roller 3, then from the pressure roller 2.

I claim:

1. A device for coating opposite sides of a web, comprising:

a frame;

guide means for guiding a web to be coated along a web path;

first and second pressure rollers mounted on said frame along said web path and juxtaposed with one another and forming a nip through which said web runs, said rollers being rotatable about respective parallel axes and having a common tangent extending perpendicular to a line connecting said axes of rotation;

pivot means for supporting the first roller so that it is circumferentially movable against the second roller;

metering means mounted on said frame outside said path for controllably applying a coating substance on each of circumferences of the rollers; and actuating means for relatively displacing first and second rollers with a component of the displacement lying in the direction of said common tangent for adjusting said nip.

2. The device defined in claim 1 wherein said actuating means controllably displaces the one roller linearly vertically.

3. The device defined in claim 1 wherein said second roller is displaceably fixed, said means for supporting controllably displacing said first roller along a circumferential path.

4. The device defined in claim 1 wherein said line connecting the axes of rotation is angularly swingable at 5°to 10° about one of the axes of rotation in opposite directions upon displacing said one of the rollers by said actuating means.

* * * * *